United States Patent [19]

Yamamoto

[11] 4,114,331

[45] Sep. 19, 1978

[54] EXTERIOR WINDOW UNIT

[75] Inventor: Yukio Yamamoto, Uozu, Japan

[73] Assignee: Yoshida Kogyo K.K., Tokyo, Japan

[21] Appl. No.: 764,978

[22] Filed: Feb. 2, 1977

[30] Foreign Application Priority Data

Feb. 7, 1976 [JP] Japan ..... 51-132510

[51] Int. Cl.[2] ..... E06B 3/26

[52] U.S. Cl. ..... 52/202; 49/63; 49/404; 52/211; 52/213; 160/90

[58] Field of Search ..... 49/425, 404, 406, 409, 49/410, 411, 125; 160/90, 197; 52/202, 204, 206, 208, 211, 213; 16/87 R, 87 B, 94 R, 96 R

[56] References Cited

U.S. PATENT DOCUMENTS

| | | | |
|---|---|---|---|
| 2,699,825 | 1/1955 | Stritzler | 49/63 |
| 2,904,854 | 9/1959 | Adamson | 52/202 |
| 3,947,998 | 4/1976 | Matsubara | 49/404 |
| 3,984,954 | 10/1976 | Takeda | 52/211 |

FOREIGN PATENT DOCUMENTS

| | | | |
|---|---|---|---|
| 1,433,507 | 2/1966 | France | 49/63 |
| 603,879 | 6/1948 | United Kingdom | 16/87 B |

*Primary Examiner*—John E. Murtagh

*Attorney, Agent, or Firm*—Hill, Gross, Simpson, Van Santen, Steadman, Chiara & Simpson

[57] ABSTRACT

An exterior window unit is adapted to cover an opening in a building wall. A frame sill has a vertical mounting portion adapted to be mated with and secured to a fixed sill in the building wall. The frame sill has a plurality of rail portions extending along the length of the vertical mounting portion and spaced vertically along the height thereof. A plurality of sashes are mounted within the window frame in parallel closely spaced planes and have at their respective lower edges engaging means with which the rail portions engage for guiding the horizontal movement of the sashes therealong.

5 Claims, 4 Drawing Figures

EXTERIOR WINDOW UNIT

BACKGROUND OF THE INVENTION

1. Field of the Invention

This invention relates to a window unit having an improved frame sill for mounting on a pre-installed sill disposed in an opening of a building wall.

2. Prior Art

Frame sills of the heretofore-proposed exterior window units shown in U.S. Pat. No. 3,984,954, issued Oct. 12, 1976 generally include a generally horizontally extending base portion having a plurality of parallel horizontally spaced rails or flanges formed on its upper surface for rolling engagement with respective rollers carried by the associated sashes at their lower edges for guiding the horizontal movement of the sashes therealong, and a vertical mounting portion extending upwardly from the horizontal base portion at its inner edge adapted to be mated with and secured to a vertical exterior surface of a pre-installed sill in a building opening. Since a plurality of rails are disposed in parallel side by side relation, the horizontal base portion has a relatively great width, which detracts from the appearance of the frame sill. Even more important is the ability of the horizontal base portion to support the overall load of the sashes. Where the sashes are heavy, the horizontal base portion is susceptible to deformation along a line at which the horizontal base portion and the vertical mounting portion are connected together. To avoid this, it was necessary to reinforce the horizontal base portion. The most common approach was to provide a frame sill in the form of a hollow structure of generally rectangular cross section. This procedure is undesirable, however, because it not only adds to the material cost but also retards the installation of the frame sill. A further difficulty encounterd with the conventional frame sills is the problem of preventing rain water from intruding into the interior of a building through the exterior window unit. It was necessary to increase the height of the vertical mounting portion to provide better weather resistance.

SUMMARY OF THE INVENTION

It is therefore an object of this invention to provide an exterior window unit having a frame sill which is simplified in design, sturdy in construction, and inexpensive in manufacture.

Another object is to provide a frame sill which is capable of providing a better weather resistance and of easy and rapid installation.

An exterior window unit has a sill having a vertical mounting portion adapted to be mated with and secured to a vertical exterior surface of a first sill fixed in a wall opening; and a plurality of vertically spaced rail portions individually connected to said vertical mounting portion and supporting a corresponding number of sashes. Thus the stress produced by the mass of the sashes on the vertical mounting portion is distributed along a corresponding number of connections.

Many other advantages and features of the present invention will become manifest to those versed in the art upon making reference to the detailed description and the accompanying sheets of drawings in which preferred structural embodiments incorporating the principles of the present invention are shown by way of example.

DETAIL DESCRIPTION OF THE PREFERRED EMBODIMENTS

Figure 1:
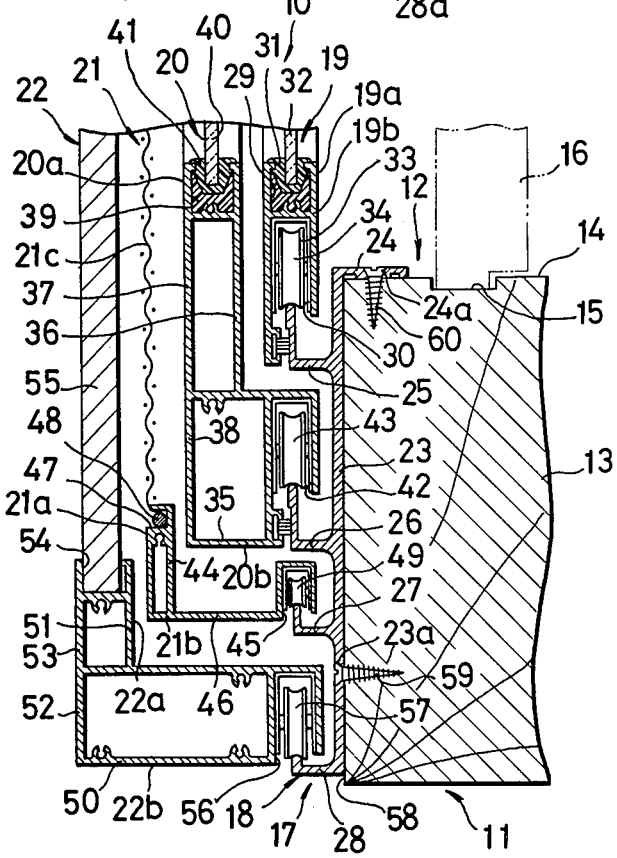
FIG. 1 is a vertical cross-sectional view through a portion of an exterior window unit provided in accordance with the present invention.

As shown in FIG. 1, an exterior window unit 10 is adapted to be mounted on the exterior of a building wall 11 for covering an opening 12 therein. The building wall 11 has a horizontally extending wooden sill 13 fixedly secured thereto, the sill having in its top surface 14 a longitudinal groove 15 in which the lower edge of an interior sash 16 is received for horizontal sliding movement therealong.

Figure 2:
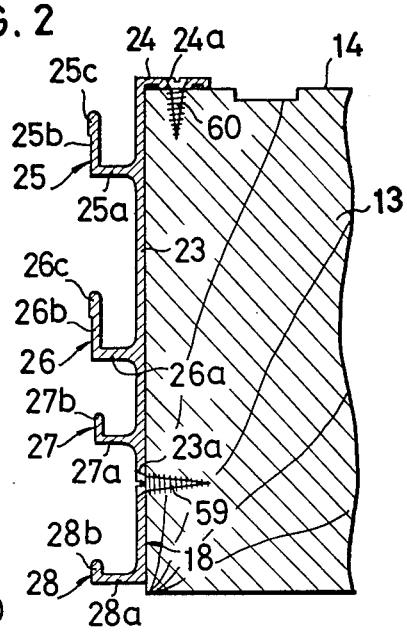
FIG. 2 is a repetition of a portion of FIG. 1.

The exterior window unit 10 generally comprises a frame 17 made of extruded aluminum and including a horizontally extending sill 18, a pair of intermediate sashes 19,20, a screen sash 21, and an exterior sash 22, these sashes being mounted within the frame 17 in parallel closely spaced planes. Although not shown in the drawings, the frame 17 also includes a horizontally extending header and a pair of spaced apart vertical jambs interconnecting the header and sill 18 at their respective opposite ends to define a rectangular opening. The frame sill 18 extends along the length of the wooden sill 13 and includes a solid body of generally inverted L-shaped cross-section having a vertical mounting portion 23 and a horizontal mounting portion 24 extending inwardly and right-angularly from the vertical mounting portion 23 at its upper edge. The frame sill 18 also includes a plurality of longitudinal rail portions 25,26,27,28 formed integrally with the exterior surface of the vertical mounting portion 23, the plurality of rail portions extending along the length of the vertical mounting portion 23 and being spaced vertically along the height thereof. The first and second rail portions 25,26 are identical in configuration and each includes a body of L-shaped cross-section having a horizontal section *25a,26a* (FIG. 2) extending outwardly from the vertical mounting portion 23 and a vertical flange section *25b,26b* extending upwardly from the horizontal section at its outer edge. The upper edge portion *25c,26c* of the flange section *25b,26b* is of thickened cross-section. The third rail portion 27 has generally the same configuration as, but is slightly thinner in cross-section than each of the first and second rail portions 25,26. Also, a flange section *27b* of the third rail portion 27 is shorter than that of each of the first and second rail portions 25,26. The fourth rail portion 28 differs from the first and second rail portions 25,26 only in that it has a substantially shorter flange section *28b*. Since the horizontal sections *25a* to *28a* have the same length, the upstanding flange sections *25b* to *28b* are disposed in vertical registry with one another and hence lie in a common plane. The vertical mounting portion 23 has a series of screw holes *23a* formed therethrough and disposed intermediate the third and fourth rail portions 27,28. The horizontal mounting portion 24 has a series of screw holes *24a* formed therethrough.

The intermediate sash 19 comprises a rectangular frame *19a* including a bottom rail *19b* of generally H-shaped crosssection having a pair of upwardly and downwardly opening channel portions 29,30. Received in the upwardly opening channel portion 29 is a gasket member 31 which in turn embraces a lower peripheral margin of a glass pane 32. Rotatably mounted within the downwardly opening channel portion 30 is a roller 33 which has a peripheral groove 34 in rolling engagement with the thickened upper edge portion 25*c* of the upstanding flange section 25*b*. The roller 33 is arranged in the median plane of the intermediate sash 19 in which the glass pane 32 is disposed.

The other intermediate sash 20 comprises a rectangular frame 20*a* including a bottom rail 20*b* having a lower hollow portion 35 of rectangular cross-section and an upper hollow portion 36 of rectangular cross-section extending upwardly from the lower portion 35, the lower portion 35 being substantially equal in height to but greater in width than the upper portion 36. Exterior side sections 37,38 of the upper and lower portions 36,35 are disposed in coplanar relationship to each other. The upper hollow portion 36 has a upwardly opening channel section 39 formed at its upper edge holding a lower peripheral margin of a glass pane 40 through a gasket member 41. The lower hollow portion 35 has a downwardly opening channel section 42 at its interior side in which a roller 43 is rotatably mounted in rolling engagement with the thickened edge portion 26*c* of the upstanding flange section 26*b*, the downwardly opening channel section 42 being disposed in vertical registry with the downwardly opening channel portion 30. Thus, the roller 43 is arranged in offset relation to the median plane of the upper hollow portion 36 in which the glass pane 40 is disposed.

The screen sash 21 comprises a rectangular frame 21*a* including a bottom rail 21*b* having an outer hollow portion 44, a downwardly opening inner channel portion 45, and a horizontal web portion 46 lying between the hollow outer portion 44 and the inner channel portion 45. The hollow outer portion 44 has an outwardly opening groove section 47 at its upper edge for retaining a lower peripheral margin of a screen 21*c* through a retaining bar 48 received therein. A roller 49 is rotatably mounted within the downwardly opening channel portion 45 in rolling engagement with the upper edge portion of the upstanding flange section 27*b*, and the channel portion 45 is disposed in vertical registry with the aforesaid downwardly opening channels 30,42.

The exterior sash 22 comprises a rectangular frame 22*a* including a bottom rail 22*b* having a horizontally disposed hollow base portion 50 of rectangular cross-section and an upper hollow portion 51 of rectangular cross-section extending upwardly from the base portion 50 adjacent its outer end, exterior side sections 52,53 of the base and upper portions 50,51 being disposed in coplanar relationship to each other. The upper portion 51 has an upwardly opening channel section 54 at its upper end snugly receiving a lower peripheral margin of a panel member 55. The base portion 50 has a downwardly opening channel section 56 at its inner side within which a roller 57 is rotatably mounted in rolling engagement with the upper edge of the flange section 28*b*, the channel section 56 being disposed in vertical registry with the aforesaid channels 30,42,45.

When the exterior window unit 10 is to be installed, the window frame 17 is first fixedly mounted relatively to the building opening 12 in such a manner that the frame sill 18 is fixedly secured to the wooden sill 13, with the vertical and horizontal mounting portions 23,24 mated with and secured to the vertical exterior and horizontal top surfaces 58,14 of the wooden sill 13, respectively, by a pair of series of screws 59,60 passing through the respective screw holes 23*a*,24*a* into the wooden sill 13. Then, the pair of intermediate sashes 19,20, the screen sash 21 and the exterior sash 22 are mounted in position within the window frame 17, with the rollers 33,43,49,57 riding on their respective flange sections 25*b*,26*b*,27*b*,28*b*.

Figure 3:
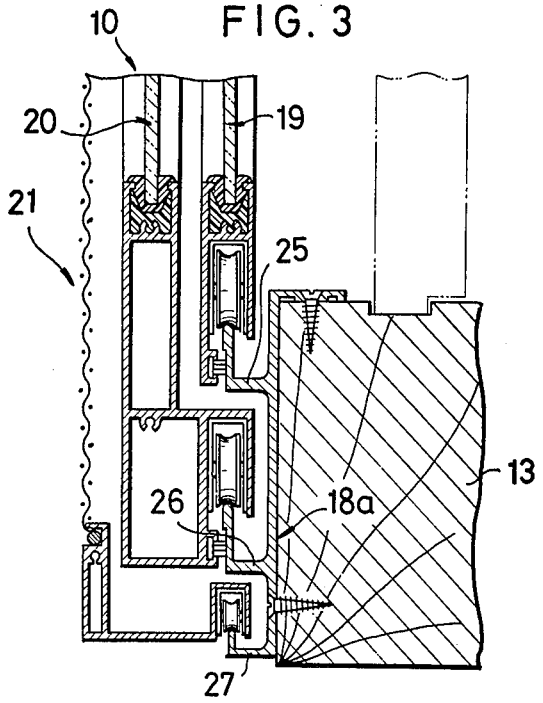

FIG. 3 shows a modified form of the invention in which that portion of the frame sill 18 extending downwardly beyond the third rail portion 27 is omitted to provide a modified sill 18*a* of shorter height which is employed where it is not required to install the exterior sash 22.

Figure 4:
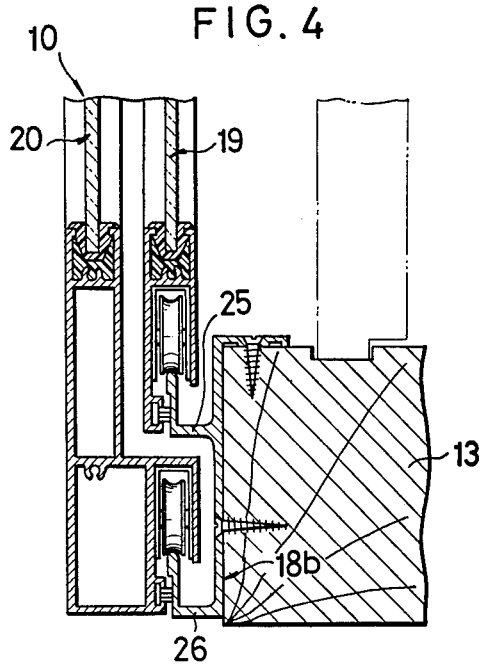
FIGS. 3 and 4 are modified thereof.

FIG. 4 shows another modification in which that portion of the frame sill 18 extending downwardly beyond the second rail portion 26 is omitted to provide modified sill 18*b* of still shorter height which is utilized where it is not required to mount the exterior sash 22 or the screen sash 21.

Since the sashes 19 to 22 are supported by their respective vertically spaced rail portions 25 to 28, the overall load of the sashes is suitably distributed along the height of the vertical mounting portion 23. This arrangement is advantageous because the frame sill 18 does not need to be provided in the form of a hollow structure in view of the mechanical strength thereof.

By virtue of the provision of the vertically spaced rail portions 25 to 28, the vertical mounting portion 23 has a substantially increased height to prevent rain water from intruding into the interior of the building through the exterior unit 10.

Although various other minor modifications may be suggested by those versed in the art, it should be understood that I wish to embody within the scope of the patent warranted hereon, all such embodiments as reasonably and properly come within the scope of my contribution to the art.

What is claimed is:

1. An exterior window unit for covering an opening in a building wall, said opening having at its lower edge a first sill, said exterior window unit comprising:

(a) a frame having a second sill for extending along the length of said first sill below the lower edge of said opening, said second sill having a vertical mounting portion with a mounting surface having means by which it may be mated flatwise with and secured to a vertical exterior surface of the first sill below said opening;

(b) a plurality of rail portions of L-shaped cross-section, each having a horizontal leg individually secured independently of each other directly to a vertical exterior surface of said vertical mounting portion at vertically spaced points opposite to said mounting surface, and each having a vertical leg directed as an upwardly extending vertical flange section each being the nearest horizontally adjacent element to said vertical mounting portion, said rail portions extending along the length of said vertical mounting portion and all said vertical legs being spaced vertically along the height of said vertical mounting portion; and (c) a plurality of sashes mounted within said frame in parallel closely spaced relationship, said plurality of sashes corresponding in number to said plurality of rail portions, said sashes having engaging means at their lower edges, respectively, engaging the upper edges of said flange portions of supporting said sashes from below and for guiding the horizontal movement of said sashes therealong.

2. An exterior window unit according to claim 1, in which said second sill has a horizontal mounting portion extending inwardly and right-angularly from said vertical mounting portion at its upper edge, said horizontal mounting portion and integral with being adapted to be mated with and secured to a horizontal top surface of the first sill.

3. An exterior window unit according to claim 1, said horizontal legs of said rail portion sextending inwardly from said vertical legs at their lower edges, said horizontal legs directly connecting said vertical legs to said vertical mounting portion at a side opposite to said mounting surface, respectively.

4. An exterior window unit for covering an opening in a building wall, said opening having at its lower edge a first sill, said exterior window unit comprising:

(a) a frame having a second sill for extending along the length of said first sill below the lower edge of said opening, said second sill having a vertical mounting portion with a mounting surface adapted to be mated flatwise with and secured to a vertical exterior surface of the first sill below said opening;

(b) a plurality of rail portions individually secured to a vertical exterior surface of said vertical mounting portion opposite to said mounting surface, said rail portions extending along the length of said vertical mounting portion and all being spaced vertically along the height thereof opposite to said mounting surface, and said rail portions having upwardly directed vertical flange sections disposed in horizontally spaced relation to said vertical mounting portions;

(c) a plurality of sashes mounted within said frame in parallel closely spaced relationship, said plurality of sashes corresponding in number to said plurality of rail portions, said sashes having engaging means at their lower edges, respectively, engaging the upper edges of said flange portions for supporting said sashes from below and for guiding the horizontal movement of said sashes therealong;

(d) said rail portions having horizontal sections, respectively, extending inwardly from said vertical flange sections at their lower edges, said sections interconnecting said vertical flange sections and said vertical mounting portion at a side opposite to said mounting surface, respectively; and (e) said horizontal sections having the same width so that said vertical flange sections are disposed in vertical registry with one another, said engaging means being also arranged in vertical registry with one another so that all of said engaging means except for that of the innermost one of said sashes are disposed in offset relationship to the median planes of their respective sashes.

5. An exterior window unit according to claim 7, the magnitude of said offset relationship increasing in a horizontally outward direction.

* * * * *